United States Patent [19]

Bradley

[11] Patent Number: 4,509,029

[45] Date of Patent: Apr. 2, 1985

[54] THERMALLY ACTUATED SWITCH

[75] Inventor: Fennimore N. Bradley, Muskegon, Mich.

[73] Assignee: Midwest Components, Inc., Muskegon, Mich.

[21] Appl. No.: 588,096

[22] Filed: Mar. 9, 1984

[51] Int. Cl.[3] ..... H01H 36/00

[52] U.S. Cl. ..... 335/208; 335/207

[58] Field of Search ..... 335/205, 206, 207, 208, 335/217

[56] References Cited

U.S. PATENT DOCUMENTS

| | | | |
|---|---|---|---|
| 3,008,019 | 11/1961 | Scheidig | 335/208 |
| 3,161,742 | 12/1964 | Bagno | 335/208 |
| 3,295,081 | 12/1966 | Bowyer et al. | 335/208 |
| 3,895,328 | 7/1975 | Kato et al. | 335/208 |
| 3,978,299 | 8/1976 | Takai | 335/208 X |
| 4,004,259 | 1/1977 | Krause | 335/208 X |
| 4,023,128 | 5/1977 | Itou et al. | 335/208 |
| 4,092,586 | 5/1978 | Dinkler et al. | 335/208 X |
| 4,121,184 | 10/1978 | Dinkler et al. | 335/208 X |
| 4,325,042 | 4/1982 | Endo et al. | 335/208 |
| 4,389,628 | 6/1983 | Sato et al. | 335/208 |

OTHER PUBLICATIONS

Brochure entitled Thermal Reed Switches (TRS) by Tohoku Metal Industries, Ltd.

*Primary Examiner*—George Harris

*Attorney, Agent, or Firm*—Price, Heneveld, Huizenga & Cooper

[57] ABSTRACT

A thermal switch includes a reed switch surrounded by a centrally located, annular collar made of a ferrite material and a pair of annular permanent magnets spaced from the ends of the ferrite collar and positioned axially toward the ends of the reed switch. The magnetic spacing can be achieved by utilization of non-magnetic spacers, and the entire structure encapsulated to provide further durability, if desired.

12 Claims, 5 Drawing Figures

THERMALLY ACTUATED SWITCH

BACKGROUND OF THE INVENTION

The present invention relates to a thermally actuated switch, and particularly, one in which a ferrite material is employed to effect switch operation at its Curie point temperature.

Thermally operated, encapsulated reed switches which employ ferrite for switching at the Curie point temperature are well-known. U.S. Pat. No. 3,295,081 represents an early design of such a switch and particularly one which switches from a normally closed position to an open position as the temperature increases. U.S. Pat. No. 4,325,042 discloses a variety of prior art switches of this general category and an improvement thereon in which the switch switches between an open and a closed position and back to an open state at two different temperatures. Switches which generally are open and switch to a closed position as temperature increases will be referred to hereinafter as an A-type switch. Switches which switch between a closed to an open position with an increase through the Curie point temperature are B-type switches.

It is well-known to those skilled in the art that A and B switch designs differ in the placement of toroidal magnets surrounding a sealed reed switch together with ferrite material placed typically adjacent the magnets. The mechanism by which the switch will change from an open to a closed state involve the attractive forces generated by the magnetic fields applied to the reed contacts at the tip ends of the contacts and over the length of the switch arms by the permanent magnets acting upon the reed switch in conjunction with the ferrite poles associated with the magnets.

Typically, it has been discovered that with A-type switches, in particular, there exists a relatively wide and variable reset temperature range, i.e., the temperatures at which the switch changes from an open to a closed state and then back to an open state, are excessive for some applications. While the B-type switches may have a temperature reset range of 1° C., typical A-type reset temperatures can be 2½° C. or more. Also, switching temperatures from unit to unit can vary quite widely in prior art A-type switches. These problems are believed to be due to the fact that the ferrite material is not perfectly homogeneous material due in part to zinc evaporation and relative zinc depletion at the surface. Further, transition of the material from a high permeability state at below the Curie temperature to a low permeability state above the Curie temperature is not sharply defined but includes a para-magnetic transition zone following the known second order Curie-Weiss relationship.

The effect of the relatively wide and variable reset temperature ranges and switching temperatures is that switches which will meet design criteria are relatively expensive due to a relatively low yield rate during quality control testing.

SUMMARY OF THE PRESENT INVENTION

The switch of the present invention provides relatively precise switching temperatures with a small standard deviation and a relatively narrow reset temperature range which is reliable, repeatable and relatively insensitive to environmental conditions. Such a switch includes a reed switch surrounded by a centrally located, annular collar made of a ferrite material and a pair of annular permanent magnets spaced from the ends of the ferrite collar and positioned axially toward the ends of the reed switch. The magnetic spacing can be achieved by utilization of non-magnetic spacers, and the entire structure encapsulated to provide further durability, if desired. The resultant A-type switch provides improved, reliable performance at a lower cost.

These and other features, advantages and objects of the present invention will become apparent upon reading the following description thereof together with reference to the accompanying drawings in which:

DETAILED DESCRIPTION OF THE PREFERRED EMBODIMENT

Figure 1:
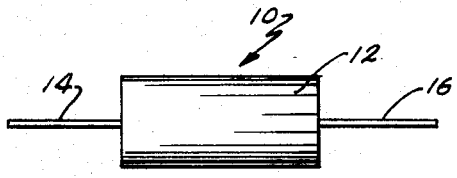
FIG. 1 is a side elevational view of an encapsulated switch embodying the present invention.

Referring initially to FIG. 1, there is shown a thermally actuated switch 10 embodying the present invention. The switch includes a generally cylindrical body capsule 12 made of a commercially available encapsulating material and from which extends at opposite ends, axially extending leads 14 and 16 for connecting the switch to an electrical circuit. The diameter of the cylindrical body 12, in one embodiment of the invention, was 0.325 inches while the overall length was approximately 0.725 inches. Within the cylindrical body 12 there is provided, as best seen in the enlarged drawing of FIG. 2, a hermetically sealed reed switch 18 having a glass envelope 20 and reed switch contacts 22 and 24 sealed within the envelope 20. The electrical leads 14 and 16 are internally welded to contacts 22 and 24 which have tip ends 23 and 25, respectively, which engage and disengage to provide the switching action either coupling conductors 14 or 16 when the switch closes above the Curie point temperature or being spaced from one another below the Curie point temperature to provide an open circuit for conductors 14 and 16.

Figure 2:
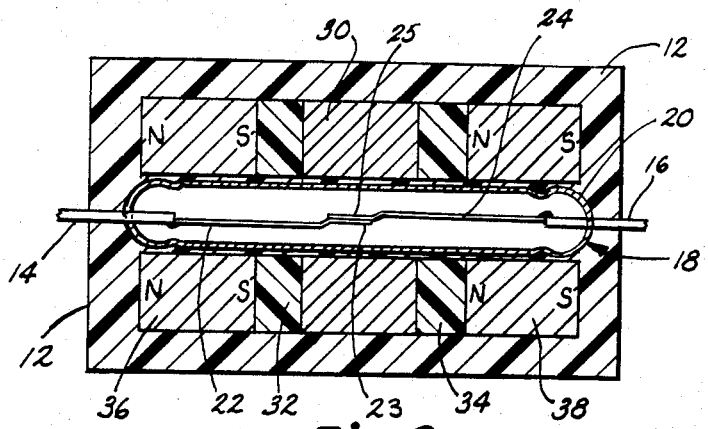
FIG. 2 is a greatly enlarged, vertical, cross-sectional view of the switch shown in FIG. 1.

Coaxially surrounding the generally cylindrical reed switch 20 and centered about the contact tips 23 and 25 is an annular ferrite sleeve 30 having an internal diameter just slightly greater than the outside diameter of the reed switch permitting it to fit snugly over the switch envelope 20. On opposite ends of the annular ferrite sleeve 30 there is provided a pair of non-magnetic disc-shaped washers 32 and 34 providing, in effect, a magnetic gap or space between the ferrite material 30 and a pair of annular, axially magnetized permanent magnet sleeves 36 and 38 positioned at opposite ends of the reed switch 18 and magnetically polarized in series alignment with one another, as shown in FIGS. 2 and 3.

In the preferred embodiment of the invention, the switch 18 is a commercially available Hamlin switch, Model No. MDSR4, and the ferrite sleeve was a commercially available manganese-zinc ferrite material having a selectable Curie point temperature from −20° C. to +130° C. The length of sleeve 30, in the preferred embodiment, was 0.15 inches while gaps 32 and 34, provided by the disc-shaped, non-magnetic washers was selected to be 0.062 inches, although 0.040 to 0.070 inches has been found to be a usable range. Each of the annular magnets 36 and 38 has a length of 0.150 inches with the outside diameter of the magnets and ferrite sleeve 30 are approximately 0.220 inches. The spacers 32 and 34 can be of any non-magnetic material, such as nylon, glass or even an air gap, however, by providing physical spacers, assembly is facilitated. The switch is manufactured by stacking the sleeves in alignment over the reed switch and encapsulating with material 12, as shown in FIG. 1 in a conventional manner.

Magnets 36 and 38 can be of a barium ferrite material having a $1\text{-}2\times10^{-6}$ gasuss-oerstead strength which is capable of withstanding temperatures up to 350° C. before losing magnetisim. By providing a pair of annular magnets at opposite ends of the reed switch and a center ferrite material having a selected Curie temperature and spacing the two magnets longitudinally from the ferrite material, the vastly improved A-type switch results. The geometric configuration is believed to result in an improved axial force tending to close the switch at temperatures above the Curie point temperature $T_C$ and a reduced transversed field below the Curie point temperature due to the addition of the selected gaps. Above the Curie point temperature, the gaps have no effect since the ferrite material is nonpermeable. The diagram of FIG. 3 illustrates the various forces acting on the tips 23 and 25 of the switch due to the magnetic fields.

Figure 3:
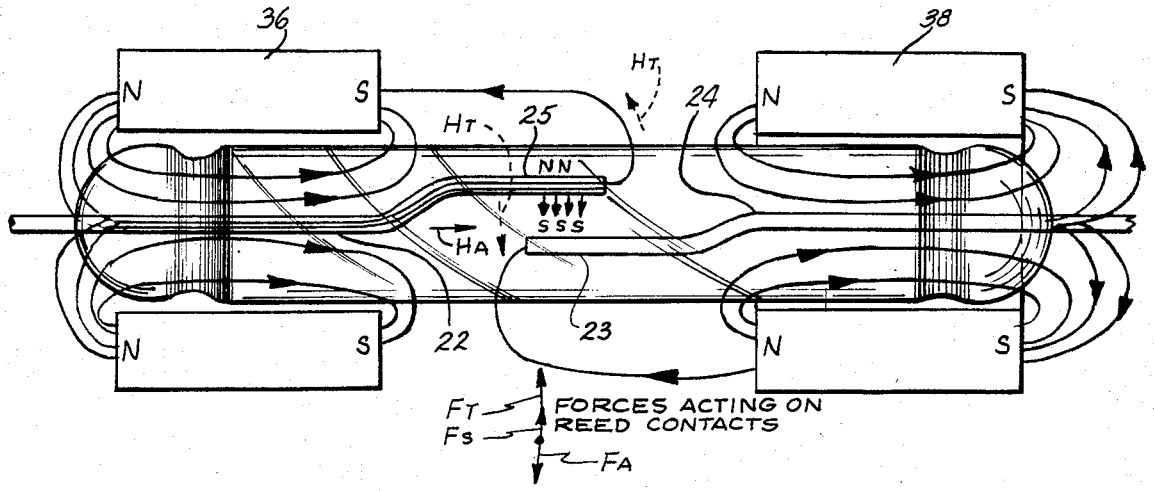
FIG. 3 is a schematic diagram showing the magnetic fields which provide switch closing and opening forces.

In FIG. 3, the force diagram shown below tip end 23 represents the force $F_T$ on contact tip 25 due to the transverse magnetic field $H_T$, shown in the Figure. The axial magnetic field $H_A$ induces north and south poles on the open contacts, as shown, and operates in a direction opposite the transverse field and the spring force $F_S$ due to the reed switch contact arms 22 and 24 resisting closing of the switch. Below $T_C$, the permeability of sleeve 30 is relatively high and the sum of the force caused by the transverse field and the spring force is greater than the attraction caused by of the axial field. It is believed that the narrower reset range provided by the improved switch of this invention is due to combining the effects of reducing the transverse magnetic field $H_T$ and increasing the axial magnetic field $H_A$ as the temperature approaches and passes the Curie point temperature $T_C$. This effect is achieved by selecting the gap between the magnets as well as positioning the magnets near the ends of the reed switch, as illustrated in FIG. 2.

Figure 4:
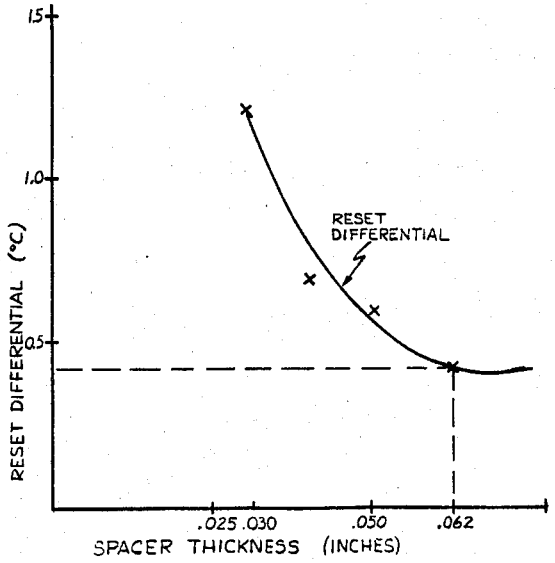
FIG. 4 is a graph illustrating the effect of the magnet spacing gap on the reset temperature differential.
Figure 5:
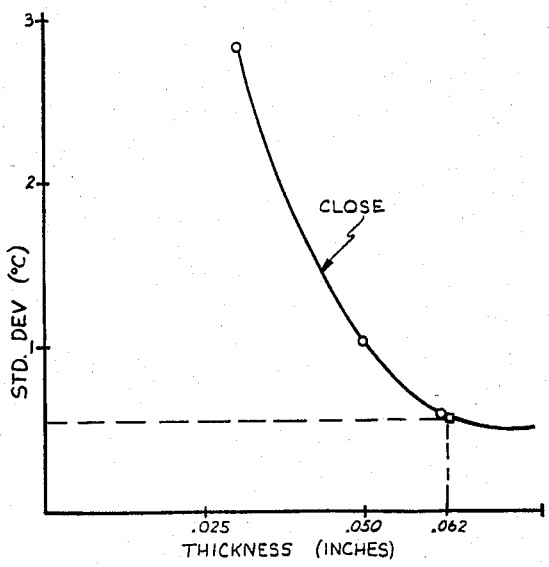
FIG. 5 is a graph illustrating the effect of the magnet spacing gap on switching temperatures.

The vast improved results provided by the switch of the present invention is illustrated in part in FIG. 4 which graphically illustrates the effect and importance of the spacer thickness on switching reset differential. In changing the gap from approximately 0.030 of an inch to approximately 0.062 of an inch, for example, the reset differential drops from approximately 1.2° C. to slightly less than ½° C. The standard deviation of temperature at which a sample of several of the A-type switches made according to the preferred embodiment actually switch are greatly reduced, as illustrated in FIG. 5. At the 0.030 inch gap, the standard deviation is approximately 2.8° C., while at 0.062 of an inch the standard deviation is approximately 0.7° C. Thus, with the switch design of the present invention, an A-type thermally operated switch is provided which is reliable, has a substantially reduced reset differential and which switches at a prescribed temperature, and yet, one which is economical to manufacture.

It will become apparent to those skilled in the art that some modifications to the preferred embodiment can be made without departing from the spirit or scope of the present invention as defined by the appended claims.

The embodiments of the invention in which an exclusive property or privilege is claimed are defined as follows:

1. A thermal switch comprising:

a cylindrical enclosure including a pair of electrical contact arms extending longitudinally inwardly from opposite ends thereof and spaced from one another, said contact arms having contacts at a free end which overlay one another in spaced relationship, said contact arms made of a ferromagnetic material;

an annular ferrite sleeve surrounding said enclosure and axially aligned with said contacts, said ferrite sleeve having a preselected Curie point temperature at which its permeability changes;

a pair of annular permanent magnets surrounding said enclosure on opposite sides of said ferrite sleeve and aligned in series aiding relationship, said magnets each spaced from an end of said sleeve a predetermined gap distance of from about 0.04 to 0.07 inches and having outer ends which generally align with the ends of said enclosure; and means for holding said enclosure, said sleeve and said magnets in fixed relationship with respect to each other.

2. The apparatus as defined in claim 1 wherein said ferrite material changes from permeable to nonpermeable as the ambient temperature increases through said preselected Curie point temperature.

3. The apparatus as defined in claim 1 and further including a pair of annular spacers made of nonferromagnetic material and positioned adjacent opposite ends of said sleeve to define said predetermined gap distances.

4. The apparatus as defined in claim 1 wherein said holding means comprises an encapsulating compound.

5. The apparatus as defined in claim 1 wherein said enclosure and contact arms comprise a reed switch.

6. A thermally actuated single-pole single-throw normally open switch which closes above a preselected temperature comprising:

a reed switch with normally open single-pole single-throw contacts;

a sleeve surrounding said reed switch and axially aligned with said contacts, said sleeve made of a ferromagnetic material with a permeability that decreases above a predetermined temperature;

a pair of permanent magnets surrounding said reed switch on opposite sides of said ferrite sleeve and aligned in series aiding relationship, said magnets each spaced from an end of said sleeve a predetermined gap distance and having outer ends which generally align with the ends of said reed switch; and means for holding said reed switch, said sleeve, and said magnets in fixed relationship with respect to each other.

7. The apparatus as defined in claim 6 wherein said sleeve is made of a ferrite material which changes from permeable to nonpermeable as the ambient temperature increases through a preselected Curie point temperature.

8. The apparatus as defined in claim 7 wherein said predetermined gap is from about 0.040 to 0.070 inches.

9. The apparatus as defined in claim 8 wherein said sleeve has an axial length of about 0.150 inches.

10. The apparatus as defined in claim 9 wherein said magnets each have an axial length of about 0.150 inches.

11. The apparatus as defined in claim 10 wherein said gap is defined by a pair of washers made of a nonferromagnetic material.

12. The apparatus as defined in claim 11 wherein said sleeve, washers and magnets are held in position with respect to said reed switch by an encapsulating compound.

* * * * *